US010329697B2

(12) United States Patent
Lonati et al.

(10) Patent No.: US 10,329,697 B2
(45) Date of Patent: Jun. 25, 2019

(54) CIRCULAR HOSIERY KNITTING MACHINE, PARTICULARLY OF THE DOUBLE CYLINDER TYPE, WITH YARN FINGER FOR PLATED KNITTING

(71) Applicant: LONATI S.P.A., Brescia (IT)

(72) Inventors: Ettore Lonati, Botticino (IT); Fausto Lonati, Brescia (IT); Francesco Lonati, San Felice del Benaco (IT)

(73) Assignee: Lonati S.P.A., Brescia (IT)

( * ) Notice: Subject to any disclaimer, the term of this patent is extended or adjusted under 35 U.S.C. 154(b) by 47 days.

(21) Appl. No.: 15/542,587

(22) PCT Filed: Jan. 15, 2016

(86) PCT No.: PCT/EP2016/050831
§ 371 (c)(1),
(2) Date: Jul. 10, 2017

(87) PCT Pub. No.: WO2016/116380
PCT Pub. Date: Jul. 28, 2016

(65) Prior Publication Data

US 2017/0370035 A1 Dec. 28, 2017

(30) Foreign Application Priority Data

Jan. 19, 2015 (IT) ..... MI2015A0037

(51) Int. Cl.
*D04B 15/58* (2006.01)
*D04B 15/48* (2006.01)

(52) U.S. Cl.
CPC ..... *D04B 15/58* (2013.01); *D04B 15/48* (2013.01)

(58) Field of Classification Search
CPC ... D04B 9/10; D04B 9/16; D04B 9/34; D04B 15/58
See application file for complete search history.

(56) References Cited

U.S. PATENT DOCUMENTS 1,933,408 A 10/1933 Percival et al.
2,304,916 A * 12/1942 Hilker ..... D04B 15/60 66/134

(Continued)

FOREIGN PATENT DOCUMENTS

CN 1159494 9/1997
CN 103249882 8/2013

(Continued)

OTHER PUBLICATIONS

Italian Search Report related to priority application IT MI20150037, dated Apr. 17, 2015 (2 pgs.).
Italian Written Opinion related to priority application IT MI20150037, dated Apr. 17, 2015 (5 pgs.).

(Continued)

*Primary Examiner* — Danny Worrell
(74) *Attorney, Agent, or Firm* — Husch Blackwell LLP

(57) ABSTRACT

A circular hosiery knitting machine, particularly of the double cylinder type, with yarn finger for plated knitting, comprising at least one needle cylinder and a first yarn finger for dispensing a base yarn and a second yarn finger for dispensing a reinforcement yarn; the dispensing end of the body of the second yarn finger can move on command with respect to the remaining part of the body of the second yarn finger, on a plane that is substantially perpendicular to the axis of the needle cylinder, along a direction that is substantially parallel to the tangent to the needle cylinder in the grip point, by needles, of a reinforcement yarn dispensed by the second yarn finger.

6 Claims, 8 Drawing Sheets

(56) References Cited

U.S. PATENT DOCUMENTS

| | | | | | |
|---|---|---|---|---|---|
| 2,934,923 | A * | 5/1960 | Elwell | D04B 1/26 | 66/188 |
| 2,959,040 | A * | 11/1960 | Saunders | D04B 9/10 | 66/112 |
| 2,988,907 | A | 2/1961 | Oplus | | |
| 6,109,069 | A * | 8/2000 | Sangiacomo | D04B 15/58 | 66/133 |
| 7,836,731 | B2 * | 11/2010 | Lonati | D04B 15/80 | 66/133 |
| 2017/0370035 | A1 * | 12/2017 | Lonati | D04B 15/58 | |

FOREIGN PATENT DOCUMENTS

| | | | | |
|---|---|---|---|---|
| CN | 103917706 | | 7/2014 | |
| EP | 0533088 | | 3/1993 | |
| EP | 0683259 | | 11/1995 | |
| GB | 811781 | | 4/1959 | |
| GB | 997390 | A * | 7/1965 | D04B 9/10 |
| GB | 1416596 | | 12/1975 | |
| IT | 1267764 | | 11/1995 | |
| JP | 11315454 | | 11/1999 | |

OTHER PUBLICATIONS

International Search Report related to priority international application PCT/EP2016/050831, dated Feb. 18, 2016 (3 pgs.).

Written Opinion of the International Searching authority related to priority international application PCT/EP2016/050831, dated Feb. 18, 2016 (5 pgs.).

First Office Action of related Chinese application No. 2018082401760940, dated Aug. 29, 2018 (6pgs.).

* cited by examiner

CIRCULAR HOSIERY KNITTING MACHINE, PARTICULARLY OF THE DOUBLE CYLINDER TYPE, WITH YARN FINGER FOR PLATED KNITTING

The present invention relates to a circular hosiery knitting machine, particularly of the double cylinder type, with yarn finger for plated knitting.

As is known, plated knitting is a particular kind of knitting that consists in forming knitting by using two yarns and keeping these two yarns in such a mutual position that one yarn is visible on one side of the manufacture and the other yarn is visible on the opposite side of the manufacture.

Plated knitting is used to obtain particular aesthetic effects, such as for example the formation of an item of clothing that has one color on the right side that is different from the color on the reverse side, or to achieve functional effects, such as the production of an item of clothing that has one side knitted with one fiber, for example cotton, that is different from the fiber, for example wool, with which the opposite side is knitted.

These effects are achieved by feeding simultaneously two yarns to the needles of the machine, for example a circular knitting machine or hosiery knitting machine, and keeping them spaced, so that they do not become mutually entangled, while the needles form, with these yarns, new loops of knitting, knocking over the previously formed loops of knitting. During the formation of new loops of knitting, the two yarns are both in the head of the needles, as shown in FIG. 7, and must be arranged next to each other: one yarn, or base yarn, toward the axis 2*a* of the needle cylinder and one, or reinforcement yarn, toward the outside of the needle cylinder.

This correct placement of the two yarns is not easy to obtain, since the yarns usually have a round cross-section and therefore under tension tend to rotate on each other, varying their mutual arrangement.

The correct arrangement of the two yarns is even more difficult to obtain and maintain when twisted yarns are used, which, due to the residual tension caused by their production, tend to rotate about themselves, varying their mutual position.

The use of short-fiber yarns can further complicate the situation, since these fibers can create unwanted interference between the yarns, altering the position of the reinforcement yarn in the head of the needle.

In circular hosiery knitting machines, in which, during the formation of the knitting, the old loops of knitting cause the closure of the latch of the needles while they are knocked over, the rotation of the needle latch for closure can affect negatively the position of the reinforcement yarn within the head of the needles.

In double cylinder circular machines, the position of the reinforcement yarn within the head of the needles can be influenced also by the rotation of the latches of the needles that knit in reverse in the upper needle cylinder.

The incorrect arrangement of the two yarns inside the head of the needles causes the viewing of the yarn used to provide the reverse side on the right side of the manufacture or vice versa, causing the production of an item of clothing that is defective or of lower quality.

Various attempts to solve this problem have been made through the years.

One of these attempts is based on the use of cams for forming knitting (so-called "knitting triangles"), which actuate the needles, with a very steep work angle, i.e., with a reduced extension around the needle cylinder. This solution, owing to the fact that the number of needles that are forming knitting and therefore the number of needles that have their latched in the closed step is reduced, allows to reduce the negative effect of the closure of the latches on the reinforcement yarn. However, this solution has the typical drawback of the use of needle actuation cams with a very steep knitting angle, i.e., the need, in order to avoid excessive wear and breakage of the needles, to reduce the operating speed of the machine and consequently its productivity.

The aim of the present invention is to solve the problems described above, by providing a circular hosiery knitting machine, particularly of the double cylinder type, with a yarn finger that allows higher precision in plated knitting without substantially penalizing productivity.

Within this aim, an object of the invention is to provide a hosiery knitting machine, particularly of the double cylinder type, with a yarn finger for plated knitting that allows to improve the quality of the finished product in this particular type of knitting.

Another object of the invention is to provide a hosiery knitting machine, particularly of the double cylinder type, that is safe and reliable in use.

This aim, as well as these and other objects that will become better apparent hereinafter, are achieved by a circular hosiery knitting machine, particularly of the double cylinder type, with yarn finger for plated knitting, comprising at least one needle cylinder that has a plurality of axial grooves that each accommodate a needle, said needle cylinder being actuatable with a rotary motion about its own axis, arranged vertically, with respect to at least one feed or drop at which there are at least two yarn fingers for plated knitting, respectively a first yarn finger for dispensing a base yarn and a second yarn finger for dispensing a reinforcement yarn, said second yarn finger having an elongated body that comprises a dispensing end, located proximate to a longitudinal end thereof and provided with a passage for the reinforcement yarn to be dispensed to the needles of the machine arranged in said needle cylinder, and a remaining part of the body of the second yarn finger; said second yarn finger being arrangeable so that said dispensing end thereof faces laterally the needle cylinder in the working area of the needles, characterized in that said dispensing end of the body of the second yarn finger can move on command with respect to the remaining part of the body of the second yarn finger, on a plane that is substantially perpendicular to the axis of the needle cylinder, along a direction that is substantially parallel to the tangent to said needle cylinder in the grip point, by the needles, of said reinforcement yarn dispensed by said second yarn finger.

Further characteristics and advantages of the invention will become better apparent from the description of a preferred but not exclusive embodiment of the machine according to the invention, illustrated by way of nonlimiting example in the accompanying drawings, wherein:

FIG. 1 is a partial perspective view of the machine according to the invention, with the second yarn finger in an active condition;

FIG. 1*a* is an enlarged-scale view of a detail of FIG. 1;

FIG. 2 is a view of the machine according to the invention, similar to FIG. 1, but with the second yarn finger in another operating condition;

FIG. 2*a* is an enlarged-scale view of a detail of FIG. 2;

Figure 1:
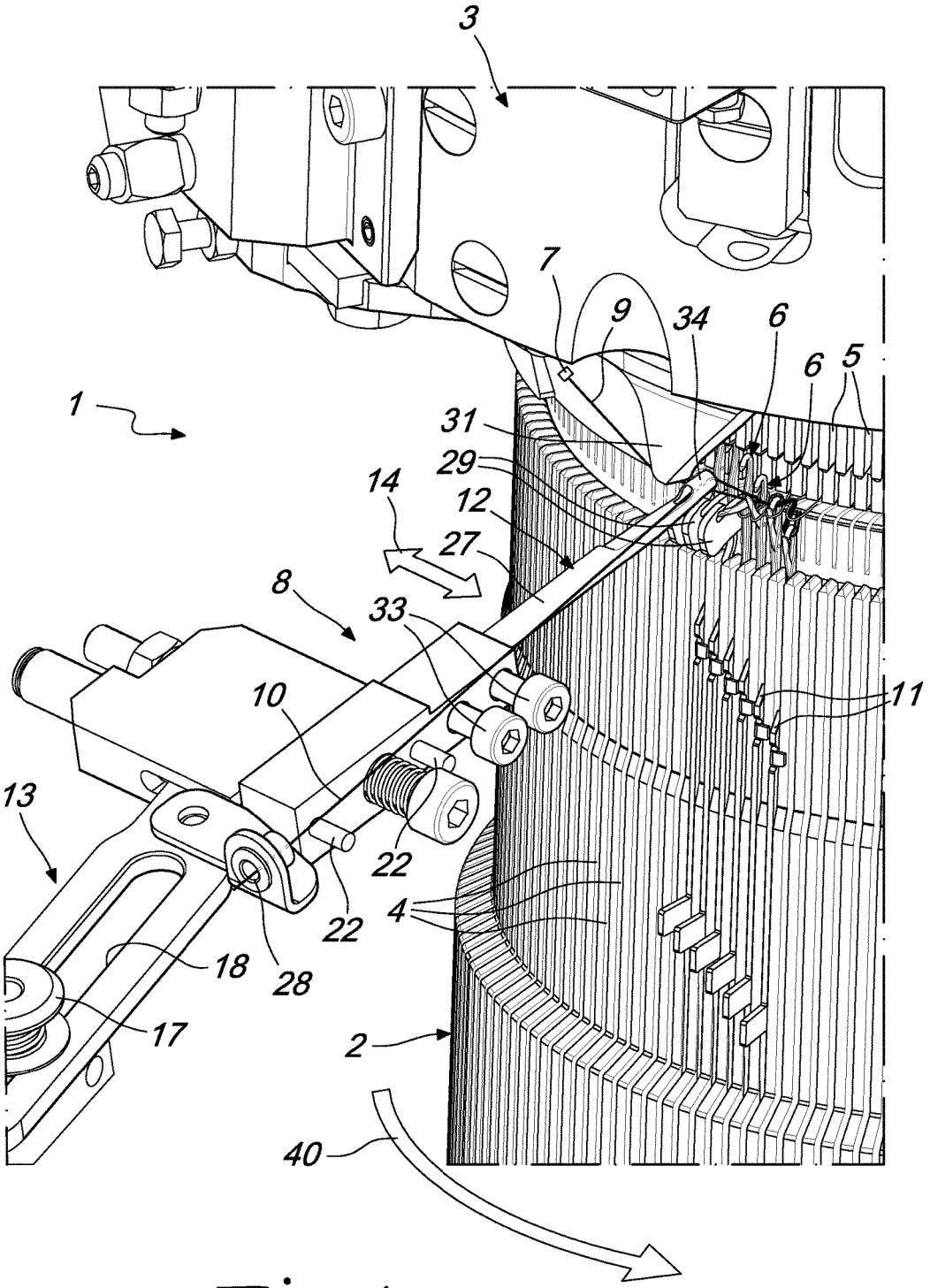

With reference to the figures, the machine according to the invention, designated generally by the reference numeral 1 and illustrated only partially for the sake of simplicity, comprises at least one needle cylinder 2, 3, which is arranged so that its axis 2*a* is vertical and has, on its lateral surface, a plurality of axial grooves 4, 5, each of which accommodates a needle 6. The needle cylinder 2, 3 can be actuated with a rotary motion about its own axis 2*a* with respect to at least one feed or drop at which at least two yarn fingers 7, 8 for plated knitting are arranged which have the function of providing the needles 6 of the machine with the yarns required to produce knitting.

Figure 2:
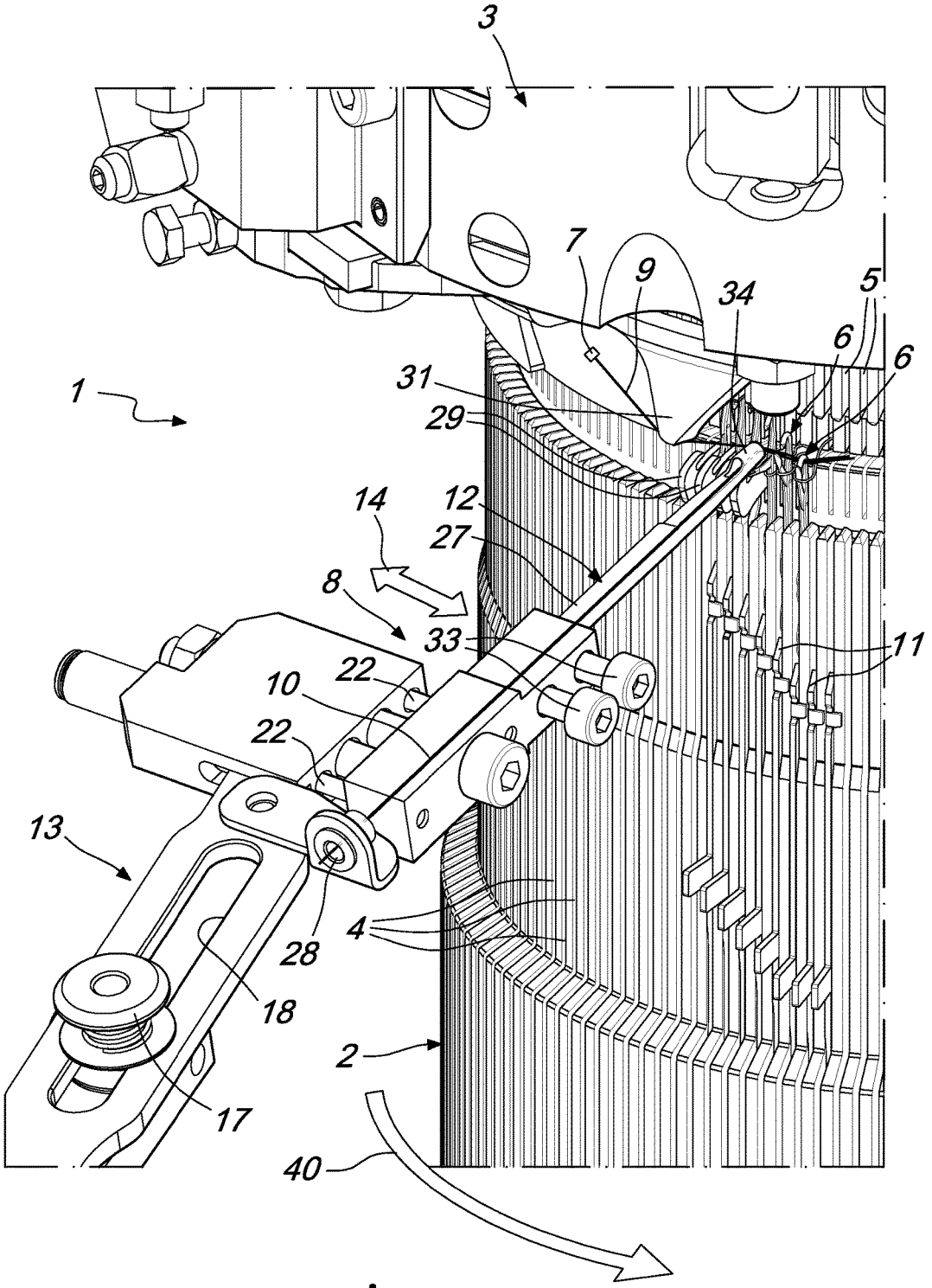
Figure 2A:
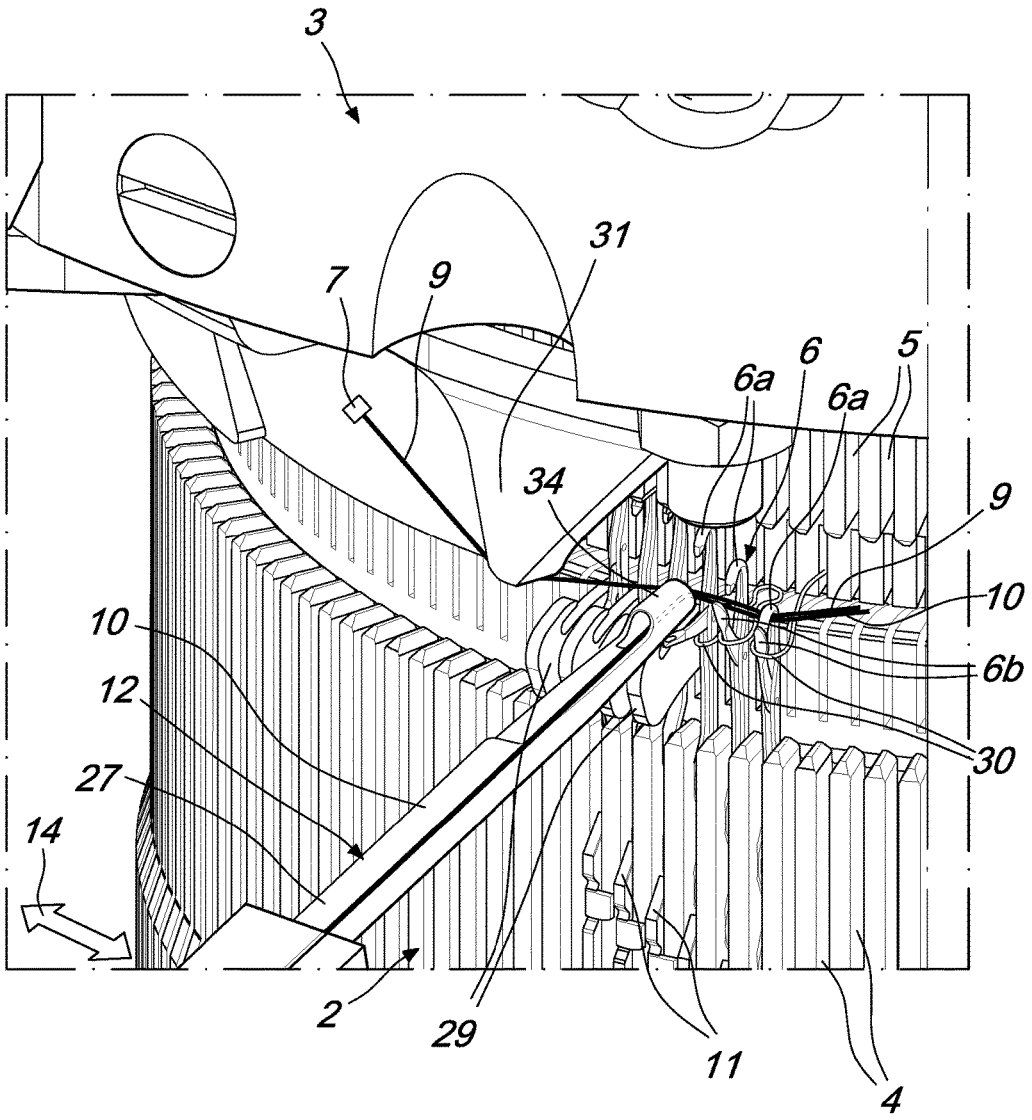
Figure 3:
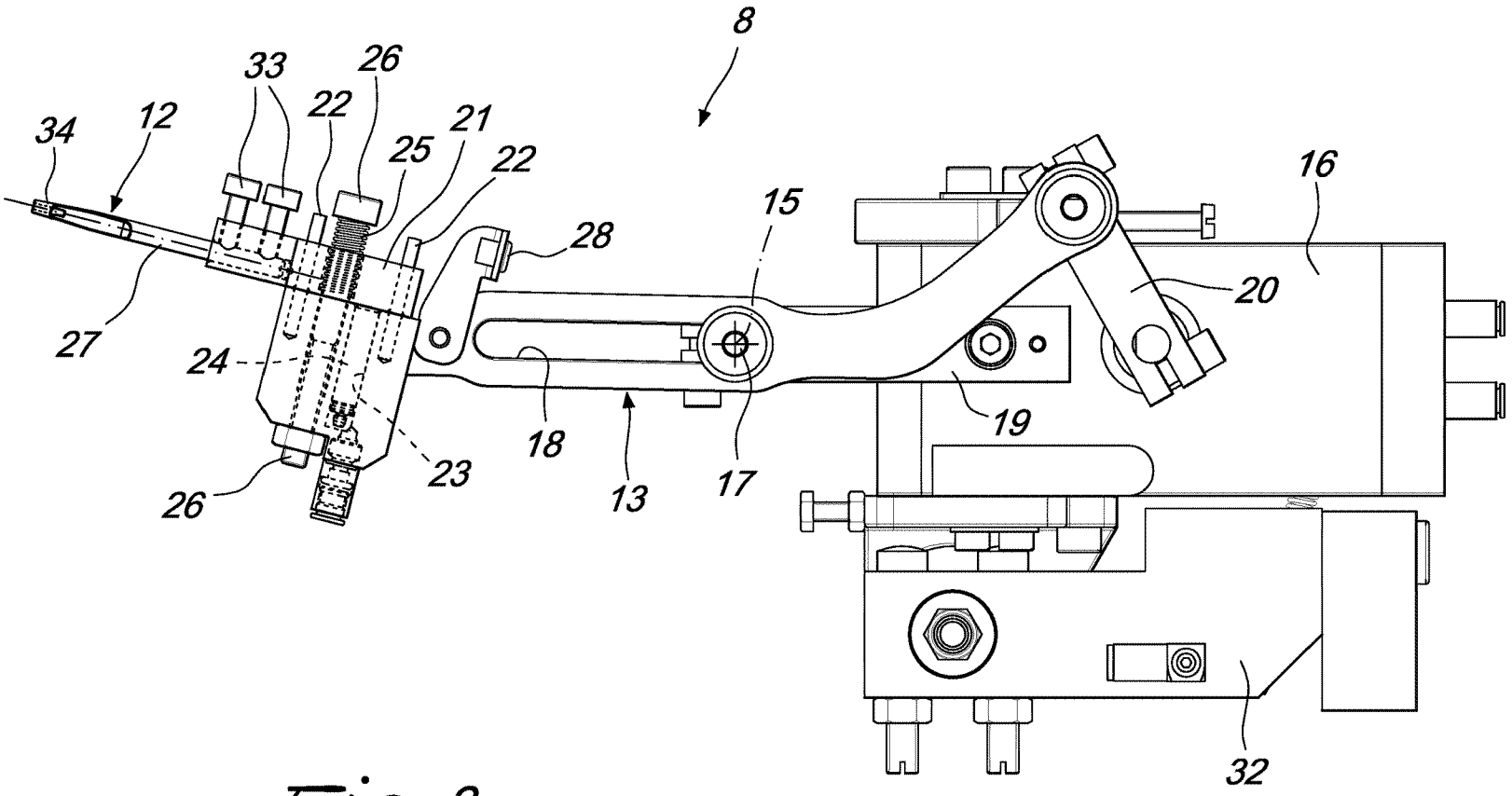
FIG. 3 is a top plan view of the second yarn finger in the operating condition shown in FIG. 1.
Figure 4:
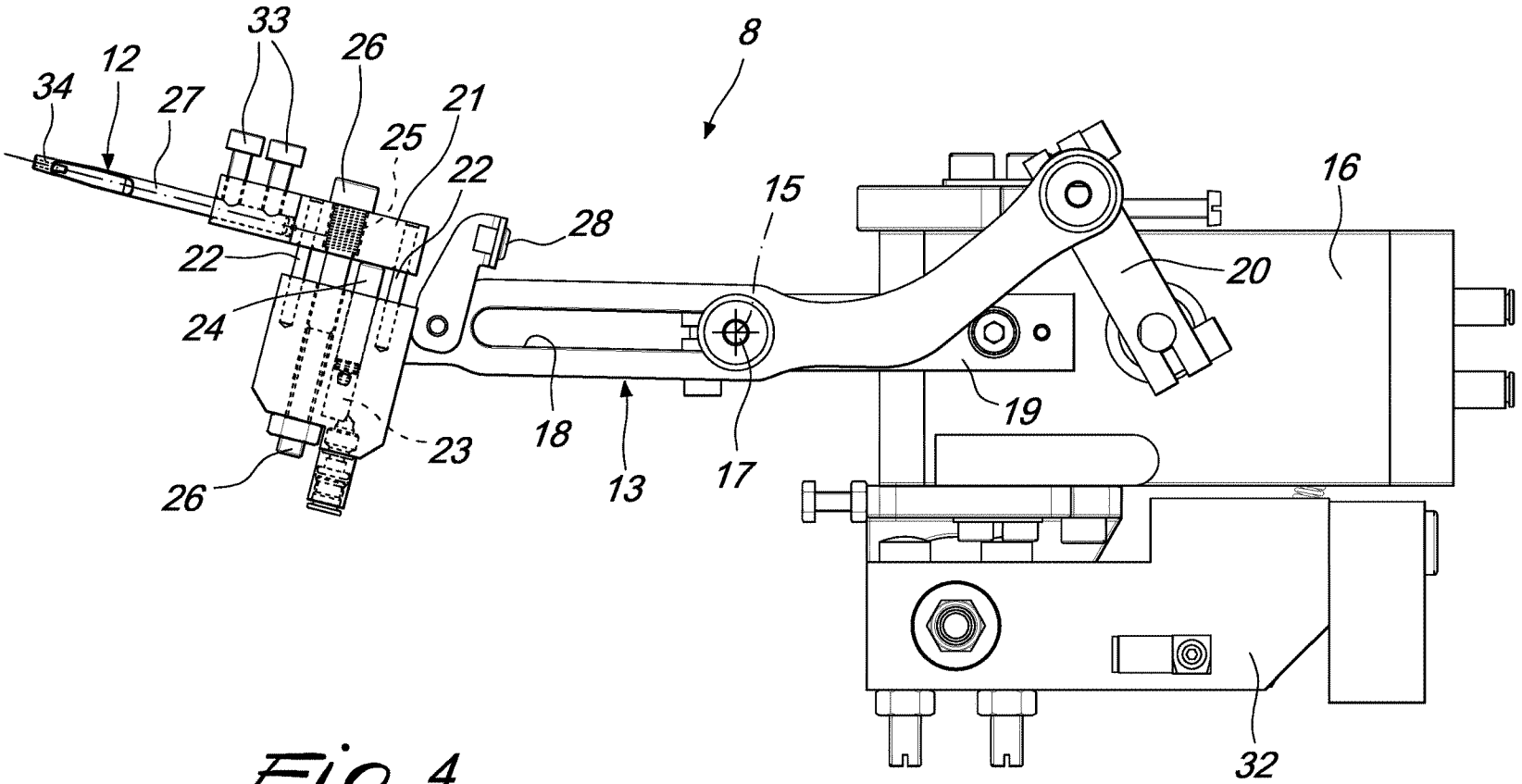
FIG. 4 is a top plan view of the second yarn finger in the operating condition shown in FIG. 2.
Figure 5:
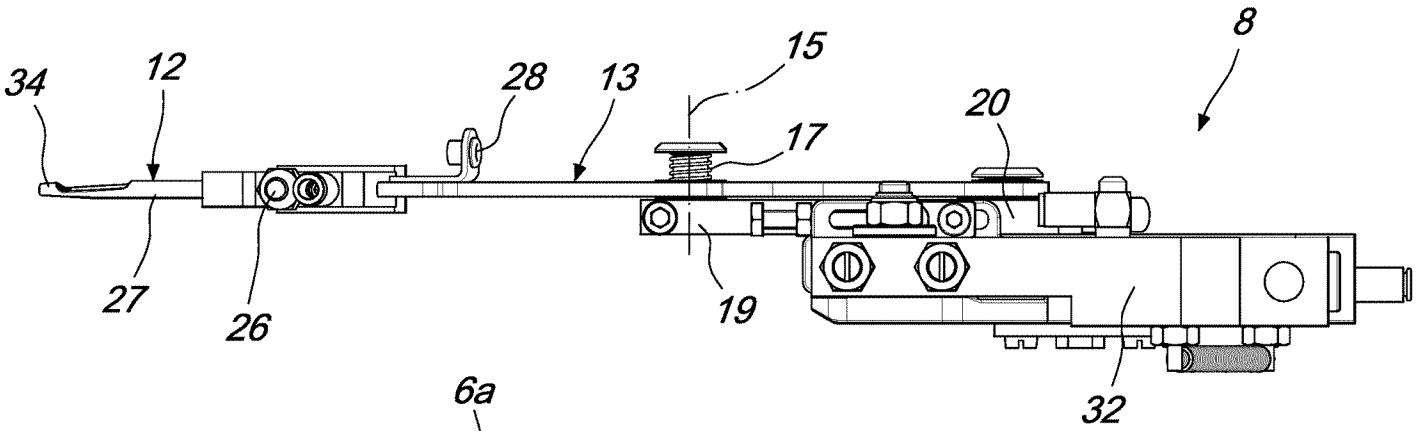
FIG. 5 is a side elevation view of the second yarn finger in the operating condition shown in FIGS. 2 and 4.
Figure 7:
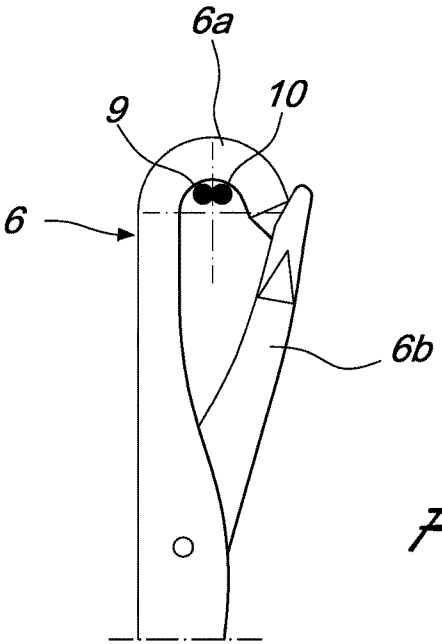
FIG. 7 is a view of the position of two yarns in the head of a needle in plated knitting.

The two yarn fingers 7, 8 comprise a first yarn finger 7, of a known type and shown schematically in FIGS. 1 and 2 by means of a square, for dispensing a base yarn 9, and a second yarn finger 8, for dispensing a reinforcement yarn 10.

The machine according to the invention, in the illustrated embodiment, is constituted by a double cylinder machine and therefore, instead of comprising a single needle cylinder, comprises two needle cylinders, respectively a lower needle cylinder 2 and an upper needle cylinder 3, which is arranged above and coaxially with respect to the lower needle cylinder 2. Both the lower needle cylinder 3 and the upper needle cylinder 3 have, in a per se known manner, on their lateral surface, a plurality of axial grooves 4, 5. The axial grooves 4 of the lower needle cylinder 2 are aligned with the axial grooves 5 of the upper needle cylinder 3, and, for each pair of axial grooves, constituted by two axial grooves 4, 5 arranged respectively in the lower needle cylinder 2, in the upper needle cylinder 3 and aligned with each other, there is a needle 6, which can be actuated with an alternating motion along the corresponding pair of axial grooves 4, 5 so as to produce knitting. Depending on whether the needle 6 is in the axial groove 4 of the lower needle cylinder 2 or in the axial groove 5 of the upper needle cylinder 3, it produces plain or purl knitting. The actuation of the needles 6, which in a per se known manner are provided with two heads 6*a* or tips arranged at their opposite axial ends, occurs by means of sliders 11 that are each accommodated in an axial groove 4, 5, respectively in the lower needle cylinder 2 and in the upper needle cylinder 3 and engage the head 6*a* of the needle 6 that is not used to produce knitting.

At least the second yarn finger 8, intended to provide the so-called reinforcement yarn 10 in plated knitting, has a body that has an elongated shape and comprises a dispensing end 12 and a remaining part 13 of the body of the second yarn finger 8. The dispensing end 12 is arranged proximate to a longitudinal end of the body of the second yarn finger 8 and is provided with a passage for the reinforcement yarn 10 to be dispensed to the needles 6 of the machine that are arranged in the needle cylinders 2, 3 and are moved to knit at the feed being considered.

The second yarn finger 8 can face, with its dispensing end 12, laterally the needle cylinders 2, 3 in the work region of the needles 6.

Figure 6:
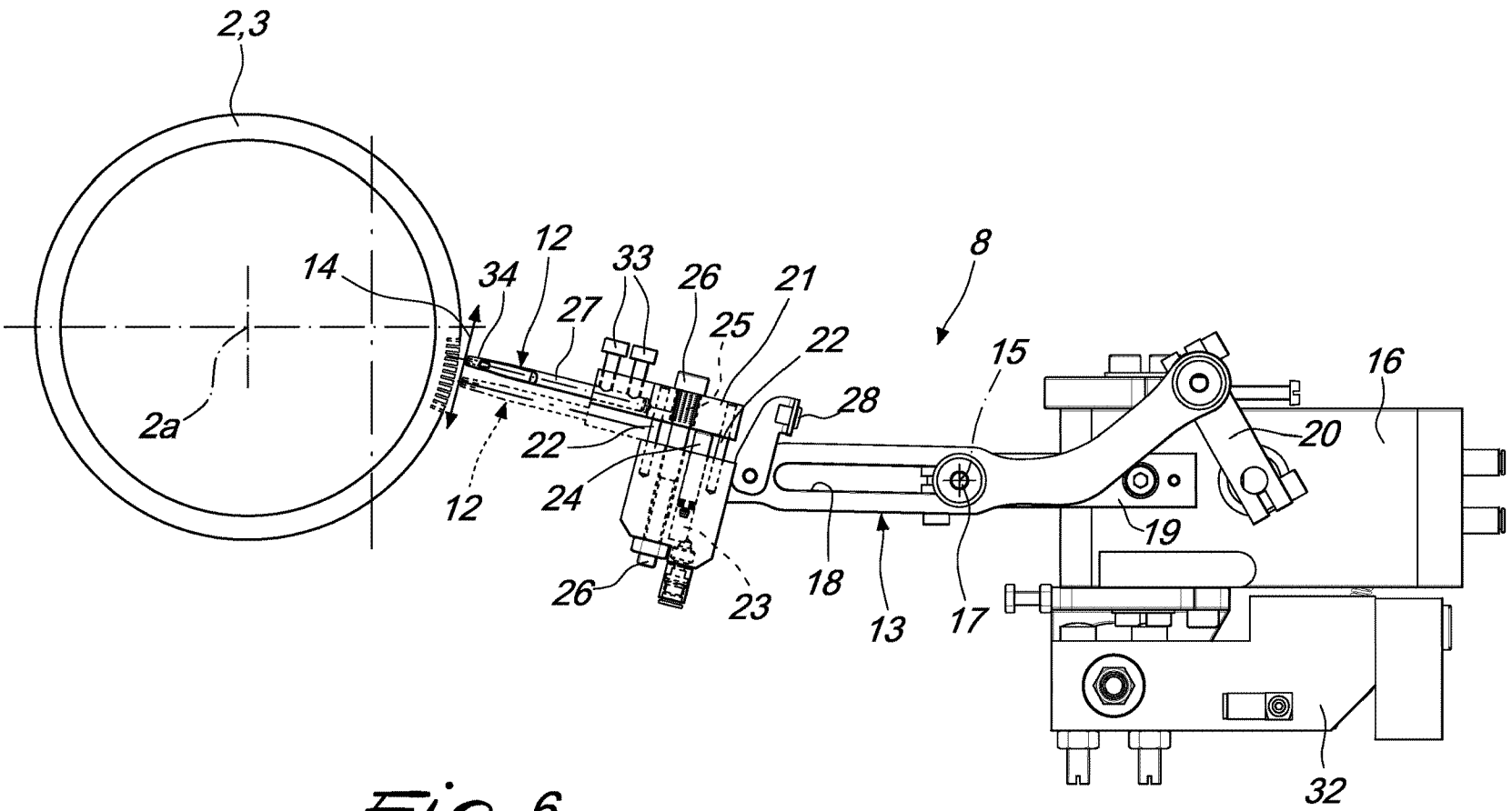
FIG. 6 is a view of the movement of the dispensing end of the body of the second yarn finger with respect to the remaining part of the body of the second yarn finger, with the second yarn finger shown in top plan view and facing laterally the needle cylinder.

According to the invention, the dispensing end 12 of the body of the second yarn finger 8 can move on command with respect to the remaining part 13 of the body of the second yarn finger 8, on a plane that is substantially perpendicular to the axis 2*a* of the needle cylinders 2, 3, along a direction 14 that is substantially parallel to the tangent to the needle cylinders 2, 3 in the grip point, on the part of the needles 6, of the reinforcement yarn 10 delivered by the second yarn finger 8, as shown in particular in FIG. 6.

More particularly, the dispensing end 12 of the body of the second yarn finger 8 can move on command with respect to the remaining part 13 of the body of the second yarn finger 8 from a dispensing start position to a plated knitting dispensing position, in which it is moved with respect to the dispensing start position, along the direction 14, in accordance with the direction of rotation of the needle cylinders 2, 3 relative to the feed being considered.

In greater detail, the body of the second yarn finger 8 is supported, so that it can rotate about a vertical axis 15, by a platelike element 16, which is intended to be associated with the supporting structure of the machine at the feed being considered.

The axis 15 about which the body of the second yarn finger 8 can rotate is defined by a pivot 17, which engages slidingly within an elongated slot 18 that passes through the body of the second yarn finger 8. The pivot 17 is moved by a plate 19, the position of which relative to the platelike element 16 can be changed so as to vary the position of the pivot 17 within the slot 18.

The end of the body of the second yarn finger 8 that lies opposite with respect to the dispensing end 12 is connected, in a per se known manner, to a crank 20, which is supported by the platelike element 16 and can rotate in order to turn the body of the second yarn finger 8 about the axis 15 defined by the pivot 17.

By way of this rotation, the second yarn finger 8 can be moved from an inactive position, in which the dispensing end 12 of the body of the second yarn finger 8 is spaced laterally with respect to the needle cylinders 2, 3, so as to avoid the grip of the reinforcement yarn 10, which exits from the dispensing end 12 of the body of the second yarn finger 8, by the needles 6 of the machine, to an active position, in which the dispensing end 12 of the body of the second yarn finger 8 is closer to the needle cylinders 2, 3, in the work region of the needles 6, so as to allow the grip of the reinforcement yarn 10 delivered through the dispensing end 12 of the body of the second yarn finger 8 by the needles 6 of the machine for forming knitting.

Substantially, the second yarn finger 8, with the corresponding actuation elements, can be provided in a manner similar to what is disclosed in IT 1,267,764.

The dispensing end 12 of the body of the second yarn finger 8 comprises a block 21, which is supported slidingly by a pair of shafts 22 that are fixed to the remaining part 13 of the body of the second yarn finger 8 and are oriented parallel to the direction 14.

The chamber of a fluid-operated cylinder 23 is provided in the remaining part 13 of the body of the second yarn finger 8 and accommodates slidingly a piston 24, which engages, by means of one of its ends, against the block 21 of the dispensing end 12 of the body of the second yarn finger 8. Feeding the chamber of the fluid-operated cylinder 23 with a pressurized fluid, for example air, causes the movement of the piston 24 toward the block 21 of the dispensing end 12 and consequently causes the sliding of the block 21 along the shafts 22, causing the passage of the dispensing end 12 from the dispensing start position to the plated knitting dispensing position.

This movement, caused by the actuation of the fluid-operated cylinder 23, is contrasted by a spring 25 that is arranged around a screw 26 that passes through the block 21 and engages the remaining part 13 of the body of the second yarn finger 8. More particularly, the spring 25 is interposed between the head of the screw 26 and a shoulder that is defined within the block 21 of the dispensing end 12 of the body of the second yarn finger 8.

The screw 26 also delimits the extent of the movement of the block 21 with respect to the remaining part 13 of the body of the second yarn finger 8 along the shafts 22.

The dispensing end 12 of the body of the second yarn finger 8 is completed by a rod 27 that is fixed to the block 21 by means of screws 33 and ends with a tube 34 through which the reinforcement yarn 10 passes.

The platelike element 16 can be fixed directly to the supporting structure of the machine or, as shown, can be connected to a supporting block 32 with respect to which its position can be adjusted, according to the requirements, as disclosed in IT 1,267,764.

For the sake of completeness in description, it should be noted that a bush 28 for the passage of the reinforcement yarn 10 that is then delivered to the needles 6 by the dispensing end 12 through the tube is applied to the body of the second yarn finger 8 in a per se known manner.

Operation of the machine according to the invention during plated knitting is as follows.

FIGS. 1 and 2 show a double cylinder circular hosiery knitting machine in which the second yarn finger 8 is arranged in the active position, with the dispensing end 12 respectively in the dispensing start position and in the plated knitting dispensing position.

These figures also show the sinkers 29 proximate to the dispensing point of the yarns 9 and 10 to the needles 6 of the machine.

The reinforcement yarn 10, in plated knitting, is delivered by the second yarn finger 8 described above, while the base yarn 9 is delivered by the first yarn finger 7, of a known type, which also is arranged at the feed being considered. The base yarn 9 passes below the latch opening cam 31, which is of a known type, and is provided to the needles 6 by following a trajectory which, proximate to the dispensing point of the reinforcement yarn 10 delivered by the second yarn finger 8, is closer to the needle cylinders 2, 3 with respect to the trajectory traced, at the same point, by the reinforcement yarn 10.

Figure 1A:
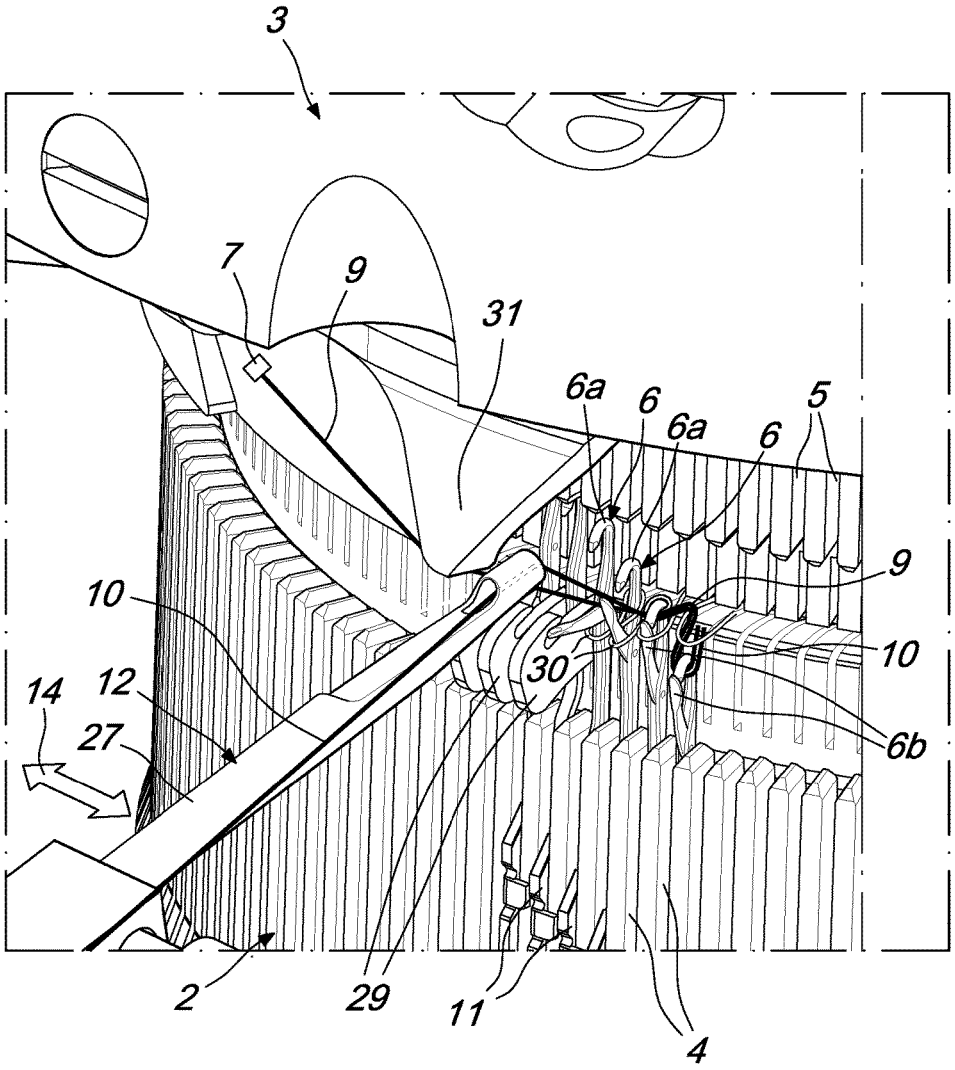

At the beginning of the dispensing of the reinforcement yarn 10, in order to ensure the correct grip of the yarn by the needles 6, the second yarn finger 8 is arranged so that the dispensing end 12 is adjacent to the latch opening cam 31 (dispensing start position) and very close to the pivoting axis of the latches **6*b* of the needles 6 that are moved to knit at the feed being considered, in a region in which the needles 6 that must pick up the reinforcement yarn 10 delivered by the second yarn finger 8 are in the point of maximum elevation or very proximate to said point, as shown in FIGS. 1 and 1*a***.

Subsequently, by way of the actuation of the fluid-operated cylinder 23, the dispensing end 12 of the body of the second yarn finger 8 is moved to the plated knitting dispensing position, in which the dispensing end 12 of the body of the second yarn finger 8 is moved, along the direction 14, laterally to the dispensing start position in accordance with the direction of rotation 40 of the needle cylinders 2, 3 relative to the feed, as shown in FIGS. 2 and **2*a* and in FIG. 6. By way of this movement, the portion of reinforcement yarn 10 that is extended from the dispensing end 12 to the needle 6 that is completing retraction with its head 6*a* into the needle cylinder 2, 3 is reduced. This yarn portion contrasts the closure rotation, produced by the previously formed loop of knitting 30, of the latches 6*b* of the needles 6 that are retracting with their head 6*a* into the needle cylinder 2, 3. In this manner, by way of the movement of the dispensing end along the direction 14, the closure rotation of the latches 6*b* of the needles 6 that pick up the reinforcement yarn 10 is delayed, and this delay achieves a better outcome of knitting-in, allowing to keep the two yarns used in plated knitting separate and correctly positioned in the head 6*a* of the needles 6**.

The same portion of reinforcement yarn 10 that delays the closure of the latches **6*b* of the needles 6 that work in the lower needle cylinder 2, as shown, achieves the same effect on the latches 6*b* of the needles 6 that knit in the upper needle cylinder 3**.

In practice it has been found that the machine with the yarn finger according to the invention achieves fully the intended aim, since it allows to achieve high precision in the arrangement of the two yarns used in plated knitting, reducing knitting errors and therefore increasing the quality of the produced manufactures.

Another advantage of the machine with the yarn finger according to the invention is that it achieves correct knitting of the two yarns used in plated knitting without the need to modify the position of the dispensing end of the yarn finger as the length of the loops of knitting varies.

The machine thus conceived is susceptible of numerous modifications and variations, all of which are within the scope of the appended claims; thus, for example, instead of using a single fluid-operated cylinder to actuate the passage of the dispensing end 12 of the body of the second yarn finger 8 from the dispensing start position to the plate knitting dispensing position, it is possible to use a plurality of fluid-operated cylinders so as to have the possibility to arrange the dispensing end 12 in a plurality of plated knitting dispensing positions, according to the requirements.

All the details may further be replaced with other technically equivalent elements.

In practice, the materials used, as well as the dimensions, may be any according to requirements and to the state of the art.

The disclosures in Italian Patent Application No. MI2015A000037 (102015902322171) from which this application claims priority are incorporated herein by reference.

The invention claimed is:

1. A circular hosiery knitting machine with yarn finger for plated knitting, comprising at least one needle cylinder that has a plurality of axial grooves that each accommodate a needle, said needle cylinder being actuatable with a rotary motion about its own axis, arranged vertically, with respect to at least one feed or drop at which there are at least two yarn fingers for plated knitting, respectively a first yarn finger for dispensing a base yarn and a second yarn finger for dispensing a reinforcement yarn, said second yarn finger having an elongated body that comprises a dispensing end, located proximate to a longitudinal end thereof and provided with a passage for the reinforcement yarn to be dispensed to the needles of the machine arranged in said needle cylinder, and a remaining part of the body of the second yarn finger; said second yarn finger being arrangeable so that said dispensing end thereof faces laterally the needle cylinder in the working area of the needles, wherein said dispensing end of the body of the second yarn finger can move on command with respect to the remaining part of the body of the second yarn finger, on a plane that is substantially perpendicular to the axis of the needle cylinder, along a direction that is substantially parallel to the tangent to said needle cylinder in a grip point, by the needles, of said reinforcement yarn dispensed by said second yarn finger.

2. The machine according to claim 1, wherein said dispensing end of the body of the second yarn finger can move on command, with respect to the remaining part of the body of the second yarn finger, from a dispensing start position to at least one plated knitting dispensing position, in which it is moved with respect to said dispensing start position along said direction in accordance with a direction of rotation of the needle cylinder with respect to said feed.

3. The machine according to claim 1, further comprising at least one fluid-operated cylinder, which is accommodated in said remaining part of the body of said second yarn finger and acts with its piston on said dispensing end of the body of the second yarn finger for its transition from said dispensing start position to said at least one plated knitting dispensing position.

4. A method for performing plated knitting on circular hosiery knitting machines, particularly double cylinder machines, comprising a step for dispensing two yarns to the needles of the machine by means of a first yarn finger and a second yarn finger arranged at a feed or drop of the machine and facing laterally the needle cylinder of the machine in the working area of the needles, respectively a first yarn finger for dispensing a base yarn and a second yarn finger for dispensing a reinforcement yarn, said second yarn finger having an elongated body that comprises a dispensing end, located proximate to one of its longitudinal ends and provided with a passage for the reinforcement yarn to be dispensed to the needles of the machine that are arranged in said needle cylinder, and a remaining part of the body of the second yarn finger; said needle cylinder being actuatable with rotary motion about its own axis, which is arranged vertically, with respect to said feed, wherein during the dispensing of the reinforcement yarn the dispensing end of the body of the yarn of said second yarn finger, facing toward said needle cylinder, is moved, on a plane that is substantially perpendicular to the axis of the needle cylinder, along a direction that is substantially parallel to the tangent to said needle cylinder in the grip point, by the needles, of said reinforcement yarn dispensed by said second yarn finger.

5. The method according to claim 4, further comprising a dispensing start step and a plate knitting dispensing step, during said plate knitting dispensing step said dispensing end of the body of the second yarn finger being moved, with respect to its position during said dispensing start step, along said direction in accordance with the direction of rotation of the needle cylinder with respect to said feed.

6. The method according to claim 5, wherein the movement of said dispensing end of the body of the second yarn finger from the position occupied in said dispensing start step to the position occupied in said plate knitting dispensing step is actuated by moving said dispensing end with respect to the remaining part of the body of the second yarn finger along said direction.

* * * * *